US010816250B2

(12) United States Patent
Liu et al.

(10) Patent No.: US 10,816,250 B2
(45) Date of Patent: Oct. 27, 2020

(54) AIR CONDITIONER AND METHOD FOR CONTROLLING THE SAME

(71) Applicant: QINGDAO HISENSE HITACHI AIR-CONDITIONING SYSTEMS CO., LTD., Qingdao, Shandong (CN)

(72) Inventors: Yang Liu, Shandong (CN); Chengjun He, Shandong (CN); Junxi Zhang, Shandong (CN)

(73) Assignee: QINGDAO HISENSE HITACHI AIR-CONDITIONING SYSTEMS CO., LTD., Qingdao, Shandong (CN)

( * ) Notice: Subject to any disclaimer, the term of this patent is extended or adjusted under 35 U.S.C. 154(b) by 113 days.

(21) Appl. No.: 16/112,345

(22) Filed: Aug. 24, 2018

(65) Prior Publication Data

US 2019/0072307 A1 Mar. 7, 2019

(30) Foreign Application Priority Data

Jul. 31, 2017 (CN) ..... 2017 1 0639175

(51) Int. Cl.
*F25B 49/02* (2006.01)
*F04B 49/00* (2006.01)

(52) U.S. Cl.
CPC ..... *F25B 49/022* (2013.01); *F04B 49/00* (2013.01); *F25B 2500/26* (2013.01); *F25B 2600/024* (2013.01); *F25B 2700/21155* (2013.01)

(58) Field of Classification Search
CPC combination set(s) only.
See application file for complete search history.

(56) References Cited

U.S. PATENT DOCUMENTS 4,901,537 A * 2/1990 Yoshikawa ..... E04F 11/1842 62/235.1
5,305,822 A * 4/1994 Kogetsu ..... F24F 3/1405 165/225

(Continued)

FOREIGN PATENT DOCUMENTS

CN 101105320 A 1/2008
CN 101392745 A 3/2009

(Continued)

OTHER PUBLICATIONS

International Search Report dated Nov. 7, 2018 for PCT Application No. PCT/CN2018/102270, Chinese language only (11 pp.).

(Continued)

*Primary Examiner* — Nelson J Nieves
(74) *Attorney, Agent, or Firm* — Brinks Gilson & Lione

(57) ABSTRACT

An air conditioner and a control method thereof are provided. The air conditioner includes: a compressor including a coil; an oil pool connected to the compressor through an oil piping; a main control board configured to receive a power-on signal of the air conditioner, obtain an actual temperature of the oil pool after receiving the power-on signal, generate a required heating amount in response to the actual temperature of the oil pool being lower than a preset startup temperature, and generate timing control signals according to the required heating amount; a power device, wherein two sides of the power device are respectively connected to the main control board and the coil, and the power device is configured to drive the coil to heat the oil pool according to the timing control signals generated by the main control board.

19 Claims, 6 Drawing Sheets

(56) References Cited

U.S. PATENT DOCUMENTS

| | | | | |
|---|---|---|---|---|
| 5,396,776 | A * | 3/1995 | Kim | F25B 13/00 62/115 |
| 5,806,322 | A * | 9/1998 | Cakmakci | B01D 53/04 62/85 |
| 2003/0014988 | A1* | 1/2003 | Watanabe | F25B 41/04 62/201 |
| 2005/0229614 | A1* | 10/2005 | Ansted | A47F 3/0482 62/150 |
| 2007/0271938 | A1* | 11/2007 | Shaffer | F25B 27/00 62/228.1 |
| 2012/0198863 | A1* | 8/2012 | Hall | F25D 21/006 62/80 |
| 2013/0152605 | A1* | 6/2013 | Mimata | F25B 21/04 62/3.3 |
| 2014/0138451 | A1* | 5/2014 | Pham | F25B 49/022 237/12 |
| 2015/0056059 | A1* | 2/2015 | Crane | F04D 27/002 415/1 |
| 2016/0010654 | A1* | 1/2016 | Hasegawa | F04D 29/063 184/104.1 |
| 2016/0061207 | A1* | 3/2016 | Penn, II | F04B 35/04 417/44.1 |
| 2016/0061504 | A1* | 3/2016 | Penn, II | F25B 47/025 62/80 |
| 2016/0201964 | A1* | 7/2016 | Ochiai | F25B 13/00 62/193 |
| 2019/0097559 | A1* | 3/2019 | Li | H02P 21/18 |
| 2019/0346182 | A1* | 11/2019 | Ishiyama | F25B 49/02 |
| 2020/0021231 | A1* | 1/2020 | Yamakawa | H02P 25/18 |

FOREIGN PATENT DOCUMENTS

| | | | |
|---|---|---|---|
| CN | 101949570 | A | 1/2011 |
| CN | 203733014 | U | 7/2014 |
| CN | 104165441 | A | 11/2014 |
| CN | 204877864 | U | 12/2015 |
| CN | 105972770 | A | 9/2016 |
| CN | 106257151 | A | 12/2016 |
| CN | 106288570 | A | 1/2017 |
| CN | 107218711 | A | 9/2017 |
| EP | 1 790 712 | A2 | 5/2007 |
| EP | 2 927 622 | A1 | 10/2015 |
| JP | H 02-217754 | A | 8/1990 |
| JP | H 11-113281 | A | 4/1999 |

OTHER PUBLICATIONS

Office Action dated Mar. 14, 2019 for China Application No. 201710639175.0, Chinese language only (10 pp.).

* cited by examiner

AIR CONDITIONER AND METHOD FOR CONTROLLING THE SAME

RELATED APPLICATION

This application claims the benefit of and priority to Chinese Patent Application No. 201710639175.0, filed on Jul. 31, 2017, and titled "Air conditioner and Method for Controlling the Same", which is hereby incorporated by reference in its entirety.

TECHNICAL FIELD

The present disclosure relates to the technical field of an air conditioner, more particularly, to an air conditioner and a control method thereof.

BACKGROUND

In recent years, the demand for air conditioners has been increasing all over the country, especially in winter and summer. In summer, the north and south regions use air conditioners to lower the indoor temperature and get a comfortable temperature at home or in an office. In winter, the north and south regions use air conditioners to heat low-temperature rooms to increase the indoor temperature, thereby getting a suitable warm temperature at home or in an office.

SUMMARY

In a first aspect, some embodiments of the present disclosure provide an air conditioner. The air conditioner includes: a compressor including a coil; an oil pool connected to the compressor via an oil piping; a main control board configured to receive a power-on signal of the air conditioner, obtain an actual temperature of the pool oil after receiving the power-on signal, generate a required heating amount in response to the actual temperature of the oil pool being lower than the preset startup temperature, and generate timing control signals according to the required heating amount; a power device, wherein two sides of the power device are respectively connected with the main control board and the coil, and the power device is configured to drive the coil to heat the oil pool according to the timing control signals generated by the main control board.

In a second aspect, some embodiments of the present disclosure provide a method for controlling an air conditioner, which is applied to, e.g. the air conditioner according to the first aspect, including: receiving a power-on signal of an air conditioner, and acquiring an actual temperature of the oil pool after receiving the power-on signal; generating a required heating amount in response to the actual temperature of the oil pool being lower than the preset startup temperature, and generating timing control signals according to the required heating amount; driving the coil to heat the oil pool according to the timing control signals.

In a third aspect, some embodiments of the present disclosure provide an air conditioner, including: a memory configured to store a computer program; a processor configured to execute the computer program, and implement the method as described in the second aspect when the computer program is executed.

In a fourth aspect, some embodiments of the present disclosure provide a computer storage medium, including: the computer storage medium being configured to store a computer program, the method as described in the second aspect being able to be implemented when the computer program is executed.

BRIEF DESCRIPTION OF THE DRAWINGS

In order to illustrate the technical solutions more clearly in some embodiments of the present disclosure, the drawings used in the description of the embodiments will be briefly described below. It is obvious that the drawings in the following description are only some embodiments of the present disclosure, and those skilled in the art can also obtain other drawings according to these drawings without paying any inventive effort.

DETAILED DESCRIPTION

Figure 1:
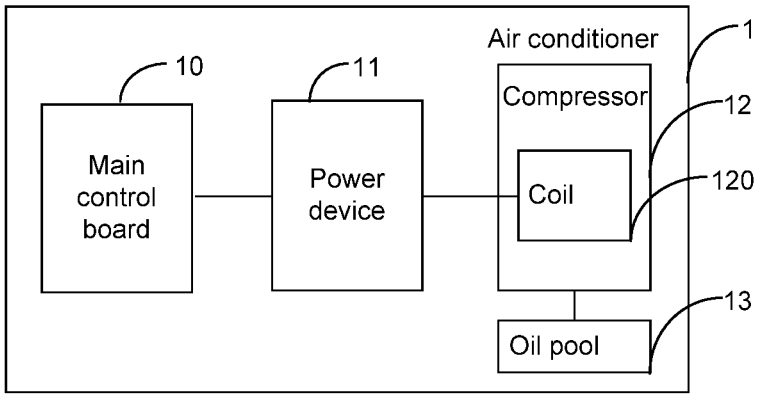
FIG. 1 is a schematic structural diagram illustrating an air conditioner provided in some embodiments of the present disclosure.

In order to make the objectives, technical solutions, and advantages of some embodiments of the present disclosure more clear, the technical solutions in some embodiments of the present disclosure will be clearly and completely described below in conjunction with the drawings in some embodiments of the present disclosure. Obviously, the described embodiments are some but not all of the embodiments in the present disclosure. All other embodiments obtained by a person of ordinary skill in the art based on the embodiments of the present disclosure without paying any inventive effort fall into the protection scope of the present disclosure.

Air conditioners are used to regulate the temperature of air, mainly for cooling in summer under high temperature conditions and heating in winter under low temperature conditions. When an air conditioner is operated under low temperature conditions, the viscosity of the lubricating oil in an internal oil pool of a compressor of an outdoor unit will be greatly increased. In this case, a great rotational torque is required to start the compressor. However, an extremely large rotational torque requires a large driving current, which may cause demagnetization of a permanent magnet inside the compressor.

At present, in order to avoid the above problem of demagnetization of the permanent magnet, an auxiliary electric heating belt is usually added to the compressor to heat the compressor, so as to reduce the viscosity of the lubricating oil inside the compressor. This method, however, involves the following problems:

Firstly, the auxiliary electric heating belt consumes a large amount of energy, and since the auxiliary electric heating belt is an additional device, the manufacturing cost of the air conditioner will be increased.

Secondly, since thermal insulation cotton is arranged around the compressor, a heating method adopts an electric heating belt involves the danger of setting fire to the air conditioner.

To this end, some embodiments of the present disclosure provide some technical solutions to avoid the demagnetization problem of the permanent magnet.

In order to clearly describe the technical solutions of some embodiments of the present disclosure, in some embodiments of the present disclosure, the words "first", "second", etc. are used to distinguish the same or similar items whose functions and actions are basically the same. Those skilled in the art can understand that the words "first", "second", etc. are not limited in terms of quantity and execution order.

In some embodiments of the present disclosure, the words "exemplarily" and "for example" are used to introduce an example, an illustration, or a demonstration. Any embodiment or design described as "exemplarily" or "for example" in some embodiments of the present disclosure should not be construed as being preferable or advantageous over other embodiments or designs. Specifically speaking, the words "exemplarily" and "for example" are intended to present relevant concepts in a specific manner.

The term "and/or" in the present disclosure is merely an association that describes associated objects, indicating that there may be three relationships. For example, A and/or B may indicate the following three cases: A exists alone, A and B exist simultaneously, and B exists alone. The symbol "/" in the present disclosure means that the associated objects have an "or" relationship, for example, A/B means A or B.

Some embodiments of the present disclosure provide an air conditioner 1. As shown in FIG. 1, the air conditioner 1 includes: a compressor 12 including a coil 120; an oil pool 13 connected to the compressor 12 through an oil piping; a main control board 10 configured to receive a power-on signal of the air conditioner, obtain an actual temperature of the oil pool 13 after receiving the power-on signal, generate a required heating amount in response to the actual temperature of the oil pool 13 being lower than a preset startup temperature, and generate timing control signals according to the required heating amount; a power device 11, wherein two sides of the power device 11 are respectively connected to the main control board 10 and the coil 120, and the power device 11 is configured to drive the coil 120 to heat the oil pool 13 according to the timing control signals generated by the main control board 10.

In some embodiments, the main control board 10 is connected to the power device 11 through a driving board, but the driving board is not necessary, and the main control board 10 can also be directly connected to the power device 11. The connection structure of the air conditioner is shown in FIG. 2; the main control board 10 may be a chip, a microchip or an integrated circuit board, and generates a control instruction according to a six-pulse algorithm, and the control instruction is sent to the driving board (the driving board may also be a chip, a microchip or an integrated circuit board), and the driving board controls the on and off of six Insulated Gate Bipolar Transistors (IGBTs) inside the power device 11 according to the control instruction to form a PWM wave (Pulse Width Modulation) on the coils S1, S2, and S3 of the compressor.

Figure 2:
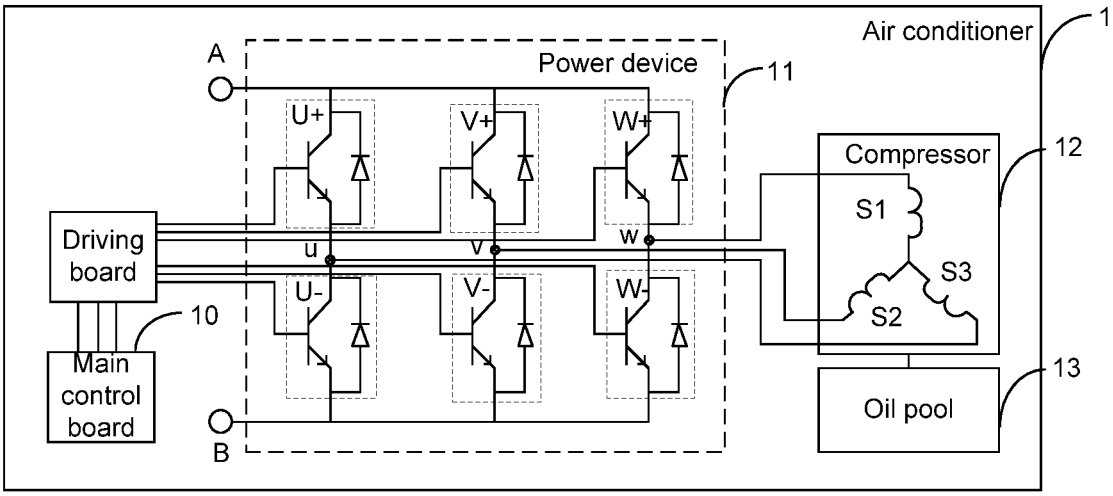
FIG. 2 is a schematic diagram illustrating a circuit configuration of an air conditioner provided in some embodiments of the present disclosure.

As shown in FIG. 2, the power device 11 includes an electrical signal input end A, an electrical signal output end B, and six IGBTs. The first IGBT is generally denoted by U+, the second IGBT is generally denoted by V+, the third IGBT is generally denoted by W+, the fourth IGBT is generally denoted by U−, the fifth IGBT is generally denoted by V−, and the sixth IGBT is usually denoted by W−. The main control board 10 controls the on and off of the six IGBTs inside the power device 11, so that alternating current (AC) and direct current (DC) in the three-phase coils S1, S2, and S3 inside the compressor 12 are superimposed with each other to achieve electromagnetic heating.

Each IGBT consists of a triode and a diode. The connection among triodes in the first to third IGBTs is as follows: a collector of the first triode, a collector of the second triode, and a collector of the third triode each is connected to the electrical signal input end A; an emitter of the first triode is connected to a collector of the fourth triode and forms a node U at the junction, and an emitter of the second triode is connected to a collector of the fifth triode and forms a node V at the junction, an emitter of the third triode is connected to a collector of the sixth triode and forms a node W at the junction; a base of the first triode is connected to a first control signal input end, a base of the second triode is connected to a second control signal input end, and a base of the third triode is connected to a third control signal input end.

The connection among diodes in the first to third IGBTs is as follows: a cathode of the first diode is connected to the collector of the first triode, and an anode of the first diode is connected to the emitter of the first triode; a cathode of the second diode is connected to the collector of the second triode, an anode of the second diode is connected to the emitter of the second triode; a cathode of the third diode is connected to the collector of the third triode, and an anode of the third diode is connected to the emitter of the third triode.

The connection among triodes in the fourth to sixth IGBTs is as follows: an emitter of the fourth triode, an emitter of the fifth triode, and an emitter of the sixth triode each is connected to the electrical signal output end B; the collector of the fourth triode is connected to the emitter of the first triode and forms the node U at the junction, the collector of the fifth triode is connected to the emitter of the second triode and forms the node V at the junction, the collector of the sixth triode is connected to the emitter of the third triode and forms the node W at the junction; a base of the fourth triode is connected to a fourth control signal input end, a base of the fifth triode is connected to a fifth control signal input end, and a base of the sixth triode is connected to a sixth control signal input end.

The connection among diodes in the fourth to sixth IGBTs is as follows: a cathode of the fourth diode is connected to the collector of the fourth triode, and an anode of the fourth diode is connected to the emitter of the fourth triode; a cathode of the fifth diode is connected to the collector of the fifth triode, and an anode of the fifth diode is connected to the emitter of the fifth triode; a cathode of the sixth diode is connected to the collector of the sixth triode, and an anode of the sixth diode is connected to the emitter of the sixth triode.

The main control board 10 is connected to the driving board, a first signal output end of the driving board is connected to the first control signal input end of the power device 11, a second signal output end is connected to the second control signal input end of the power device 11, a third signal output end is connected to the third control signal input end of the power device 11, a fourth signal output end is connected to the fourth control signal input end of the power device 11, a fifth signal output end is connected to the fifth control signal input end of the power device 11, and a sixth signal output end is connected to the sixth control signal input end of the power device 11.

The coil 120 of the compressor 12 includes: a stator coil and a rotor coil, the stator coil including a first stator coil (usually denoted by S1), a second stator coil (usually denoted by S2), and a third stator coil (usually denoted by S3), wherein the first stator coil is connected to the node W, the second stator coil is connected to the node V, and the third stator coil is connected to the node U.

The oil pool 13 stores lubricating oil and is connected to the compressor 12 through an oil piping.

In some embodiments, the Insulated Gate Bipolar Transistors can be replaced with other switching elements.

In some embodiments, all of the three stator coils in the present disclosure generate heat. The main control board performs in a cycle period any two or more of the operations of controlling the six IGBTs in a same time period, including: turning on the first IGBT, the fifth IGBT, and the sixth IGBT, and turning off the second IGBT, the third IGBT, and the fourth IGBT; turning on the first IGBT, the third IGBT, and the fifth IGBT, and turning off the second IGBT, the fourth IGBT, and the sixth IGBT; turning on the first IGBT, the second IGBT, the sixth IGBT, and turning off the third IGBT, the fourth IGBT, the fifth IGBT; turning on the second IGBT, the fourth IGBT, the sixth IGBT, and turning off the first IGBT, the third IGBT, the fifth IGBT; turning on the second IGBT, the third IGBT, and the fourth IGBT, and turning off the first IGBT, the fifth IGBT, and the sixth IGBT; turning on the third IGBT, the fourth IGBT, and the fifth IGBT, and turning off the first IGBT, the second IGBT, and the six IGBT.

In some embodiments, the frequency of the cycle period is not less than 1 kHz.

In some embodiments, the frequency of the cycle period is not less than 1 kHz but not greater than 20 kHz.

Hereinafter, each of the above operations is referred to as a phase.

There are four phases in one cycle period. The first phase: in combination with FIG. 2 and FIG. 3, the main control board controls the first IGBT to be turned on, the second IGBT to be turned off, the third IGBT to be turned off, the fourth IGBT to be turned off, the fifth IGBT to be turned on, and the sixth IGBT to be turned on; the electrical signal input end A sends an electrical signal to the emitter of the first IGBT through the collector of the first IGBT, and then the electrical signal is transmitted to the node U through the emitter of the first IGBT. The node U transmits the electrical signal to the third stator coil S3, and then the electrical signal is transmitted to the collector of the sixth IGBT via the first stator coil S1. Since the main control board has controlled the sixth IGBT to be turned on, the electrical signal is transmitted to the electrical signal output end B through the emitter of the sixth IGBT to form a power supply loop; moreover, the electrical signal is also transmitted to the collector of the fifth IGBT via the second stator coil S2, since the main control board has controlled the fifth IGBT to be turned on, the electrical signal is transmitted to the electrical signal output end B through the emitter of the fifth IGBT to form a power supply loop.

Figure 3:
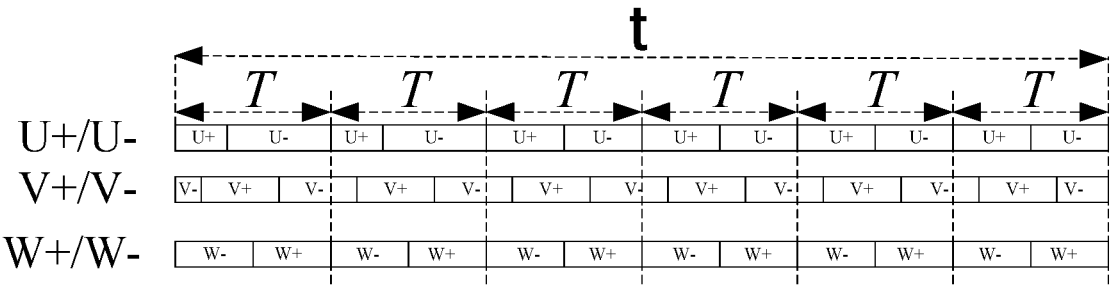
FIG. 3 is a schematic diagram of timing control signals generated by a main control board of an air conditioner according to some embodiments of the present disclosure.

The second phase: in combination with FIG. 2 and FIG. 3, the main control board controls the first IGBT to be turned on, the second IGBT to be turned on, the third IGBT to be turned off, the fourth IGBT to be turned off, the fifth IGBT to be turned off, and the sixth IGBT to be turned on; the electrical signal input end A sends an electrical signal to the emitter of the first IGBT through the collector of the first IGBT, then the electrical signal is transmitted to the node U through the emitter of the first IGBT, and the electrical signal input A sends the electrical signal to the emitter of the second IGBT through the collector of the second IGBT, then the electrical signal is transmitted to the node V through the emitter of the second IGBT. Then the electrical signal is transmitted to the third stator coil S3 via the node U, and transmitted to the second stator coil S2 via the node V, and then transmitted to the collector of the sixth IGBT via the first stator coil S1. Since the main control board has controlled the sixth IGBT to be turned on, the electrical signal is transmitted to the electrical signal output end B through the emitter of the sixth IGBT to form a power supply loop.

The third phase: in combination with FIG. 2 and FIG. 3, the main control board controls the first IGBT to be turned off, the second IGBT to be turned on, the third IGBT to be turned off, the fourth IGBT to be turned on, the fifth IGBT to be turned off, and the sixth IGBT to be turned on; the electrical signal input end A sends an electrical signal to the emitter of the second IGBT through the collector of the second IGBT, then the electrical signal is transmitted to the node V through the emitter of the second IGBT. Then the electrical signal is transmitted to the second stator coil S2 via the node V, and transmitted to the collector of the sixth IGBT via the first stator coil S1. Since the main control board has controlled the sixth IGBT to be turned on, the electrical signal is transmitted to the electrical signal output end B through the emitter of the sixth IGBT to form a power supply loop; moreover, the electrical signal is also transmitted to the collector of the fourth IGBT via the third stator coil S3. Since the main control board has controlled the fourth IGBT to be turned on, the electrical signal is transmitted to the electrical signal output end B through the emitter of the fourth IGBT to form a power supply loop.

The fourth phase: in combination with FIG. 2 and FIG. 3, the main control board controls the first IGBT to be turned off, the second IGBT to be turned off, the third IGBT to be turned on, the fourth IGBT to be turned on, the fifth IGBT to be turned on, and the sixth IGBT to be turned off. The electrical signal input end A transmits an electrical signal to the emitter of the third IGBT through the collector of the third IGBT, and then the electrical signal is transmitted to the node W via the emitter of the third IGBT. Then the electrical signal is transmitted to the first stator coil S1 via the node W, and transmitted to the collector of the fifth IGBT via the second stator coil S2. Since the main control board has controlled the fifth IGBT to be turned on, the electrical signal is transmitted to the electrical signal output end B via the emitter of the fifth IGBT to form a power supply loop; moreover, the electrical signal is also transmitted to the collector of the fourth IGBT via the third stator coil S3, and since the main control board has controlled the fourth IGBT to be turned on, the electrical signal is transmitted to the electrical signal output end B through the emitter of the fourth IGBT to form a power supply loop.

In practical applications, after the first phase, the second phase, the third phase, and the fourth phase above have been performed, the main control board controls the first IGBT, the second GBT, the third IGBT, the fourth IGBT, the fifth The IGBT and the sixth IGBT to repeat the first phase, the second phase, the third phase, and the fourth phase; that is, each cycle period T includes a first phase, a second phase, a third phase, and a fourth phase. The frequency f of each IGBT is equal to 1/T; exemplarily, the range of the frequency of the IGBT is [1 KHz, 20 KHz].

Figure 4:
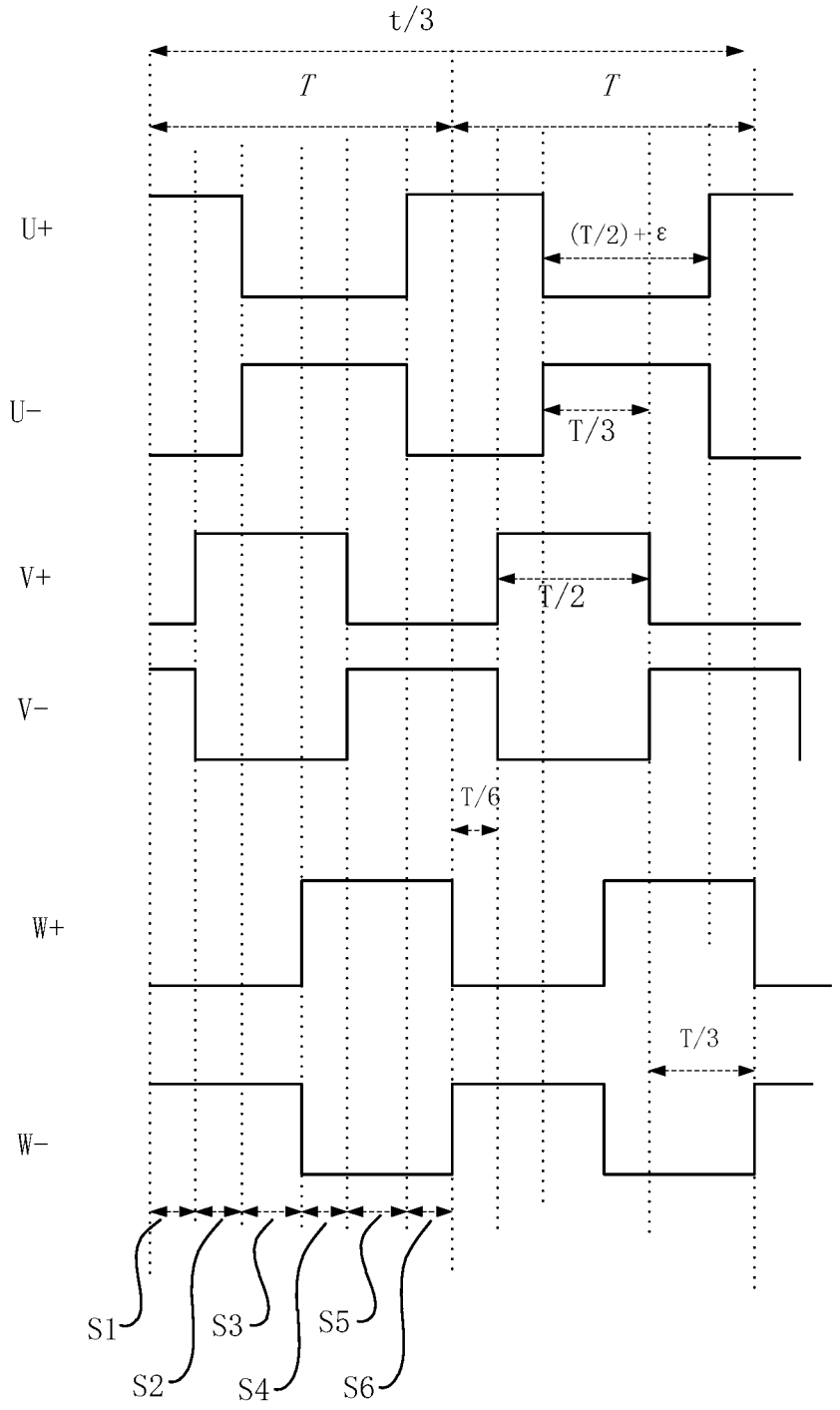
FIG. 4 is a timing control diagram of timing control signals generated by a main control board of an air conditioner according to some embodiments of the present disclosure.

As shown in FIGS. 3 and 4, in some embodiments, six phases are included in one cycle period.

The first phase S1: combining with FIG. 2, FIG. 3 and FIG. 4, the main control board controls the first IGBT to be turned on, the second IGBT to be turned off, the third IGBT to be turned off, the fourth IGBT to be turned off, the fifth IGBT to be turned on, and the sixth IGBT to be turned on; the electrical signal input end A sends an electrical signal to the emitter of the first IGBT through the collector of the first IGBT, and then the electrical signal is transmitted to the node U through the emitter of the first IGBT. The electrical signal is transmitted to the third stator coil S3 via the node U, and then transmitted to the collector of the sixth IGBT via the first stator coil S1. Since the main control board has controlled the sixth IGBT to be turned on, the electrical signal is transmitted to the electrical signal output end B through the emitter of sixth IGBT to form a power supply loop; moreover, the electrical signal is also transmitted to the collector of the fifth IGBT via the second stator coil S2, and since the main control board has controlled the fifth IGBT to be turned on, the electrical signal is transmitted to the electrical output terminal B through the emitter of the fifth IGBT to form a power supply loop.

The second phase S2: combining with FIG. 2, FIG. 3 and FIG. 4, the main control board controls the first IGBT to be turned on, the second IGBT to be turned on, the third IGBT to be turned off, the fourth IGBT to be turned off, the fifth IGBT to be turned off, and the sixth IGBT to be turned on; the electrical signal input end A sends an electrical signal to the emitter of the first IGBT through the collector of the first IGBT, then the electrical signal is transmitted to the node U through the emitter of the first IGBT, and the electrical signal input A sends the electrical signal to the emitter of the second IGBT through the collector of the second IGBT, then the electrical signal is transmitted to the node V through the emitter of the second IGBT. Then the electrical signal is transmitted to the third stator coil S3 via the node U, and transmitted to the second stator coil S2 via the node V, and then transmitted to the collector of the sixth IGBT via the first stator coil S1. Since the main control board has controlled the sixth IGBT to be turned on, the electrical signal is transmitted to the electrical signal output end B through the emitter of the sixth IGBT to form a power supply loop.

The third phase S3: combining with FIG. 2, FIG. 3 and FIG. 4 the main control board controls the first IGBT to be turned off, the second IGBT to be turned on, the third IGBT to be turned off, the fourth IGBT to be turned on, the fifth IGBT to be turned off, and the sixth IGBT to be turned on; the electrical signal input end A sends an electrical signal to the emitter of the second IGBT through the collector of the second IGBT, then the electrical signal is transmitted to the node V through the emitter of the second IGBT. The electrical signal is further transmitted to the second stator coil S2 via the node V, and transmitted to the collector of the sixth IGBT via the first stator coil S1. Since the main control board has controlled the sixth IGBT to be turned on, the electrical signal is transmitted to the electrical signal output end B through the emitter of the sixth IGBT to form a power supply loop; moreover, the electrical signal is also transmitted to the collector of the fourth IGBT via the third stator coil S3. Since the main control board has controlled the fourth IGBT to be turned on, the electrical signal is transmitted to the electrical signal output end B through the emitter of the fourth IGBT to form a power supply loop.

The fourth phase S4: combining with FIG. 2, FIG. 3, and FIG. 4 the main control board controls the first IGBT to be turned off, the second IGBT to be turned on, the third IGBT to be turned on, the fourth IGBT to be turned on, the fifth IGBT to be turned off, and the sixth IGBT to be turned off. The electrical signal input end A transmits an electrical signal to the emitter of the second IGBT through the collector of the second IGBT, and then the electrical signal is transmitted to the node V through the emitter of the second IGBT, and the electrical signal input end A transmits the electrical signal to the emitter of the third IGBT through the collector of the third IGBT, then the electrical signal is transmitted to the node W through the emitter of the third IGBT. The electrical signal is transmitted to the second stator coil S2 through the node V, and transmitted to the first stator coil S1 through the node W, and then transmitted to the collector of the fourth IGBT through the third stator coil S3. Since the main control board has controlled the fourth IGBT to be turned on, the electrical signal is transmitted to the electrical signal output end B through the emitter of the fourth IGBT to form a power supply loop.

The fifth phase S5: combining with FIG. 2, FIG. 3, and FIG. 4, the main control board controls the first IGBT to be turned off, the second IGBT to be turned off, the third IGBT to be turned on, the fourth IGBT to be turned on, the fifth IGBT to be turned on, and the sixth IGBT to be turned off; the electrical signal input end A sends an electrical signal to the emitter of the third IGBT through the collector of the third IGBT, and then the electrical signal is transmitted to the node W through the emitter of the third IGBT. The electrical signal is further transmitted to the first stator coil S1 through the node W, and then transmitted to the collector of the fifth IGBT through the second stator coil S2. Since the main control board has controlled the fifth IGBT to be turned on, the electrical signal is transmitted to the electrical signal output end B through the emitter of the fifth IGBT to form a power supply loop; moreover, the electrical signal is also transmitted to the collector of the fourth IGBT through the third stator coil S3. Since the main control board has controlled the fourth IGBT to be turned on, the electrical signal is transmitted to the electrical signal output end B through the emitter of the fourth IGBT to form a power supply loop.

The sixth phase S6: combining with FIG. 2, FIG. 3, and FIG. 4, the main control board controls the first IGBT to be turned on, the second IGBT to be turned off, the third IGBT to be turned on, the fourth IGBT to be turned off, the fifth IGBT to be turned on, and the sixth IGBT to be turned off; the electrical signal input end A sends an electrical signal to the emitter of the first IGBT through the collector of the first IGBT, and then the electrical signal is transmitted to the node U through the emitter of the first IGBT, and the electrical signal input end A transmits the electrical signal to the emitter of the third IGBT through the collector of the third IGBT and then transmits the electrical signal to the node W through the emitter of the third IGBT. The node U transmits the electrical signal to the third stator coil S3, and the node W transmits the electrical signal to the first stator coil S1, and then the electrical signal is transmitted to the collector of the fifth IGBT via the second stator coil S2. Since the main control board has controlled the fifth IGBT to be turned on, the electrical signal is transmitted to the electrical signal output end B through the emitter of the fifth IGBT to form a power supply loop.

In some embodiments, other combinations of control operations can also be used for the cycle period.

In some embodiments, the cycle period T can be set in the range of 1 kHz to 20 kHz. Since a sound range that can be heard by human ears is from 20 Hz to 20000 Hz, and the loudness of sound gradually decreases with the increase of the frequency of the sound, therefore the closer to 20 kHz the frequency of IGBT is, the smaller the noise of the air conditioner heard by human ears is. At the same time, the current acting on the stator coil and the rotor coil of the compressor has both an AC component and a DC component, and the heating power of the alternating current component is related to the value of the cycle period T. The smaller the frequency of IGBT is, the larger the heating power of the AC component is. Therefore, the staff can set the frequency of the IGBT according to the actual situation, which will not be elaborated here.

Figure 5:
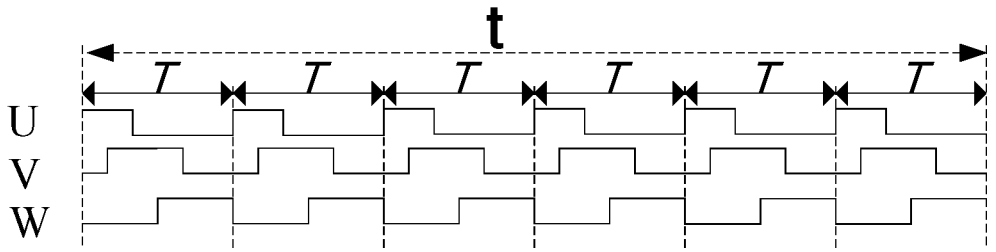
FIG. 5 is a voltage waveform diagram of three positions U, V, and W in FIG. 2 according to some embodiments of the present disclosure.
Figure 6:
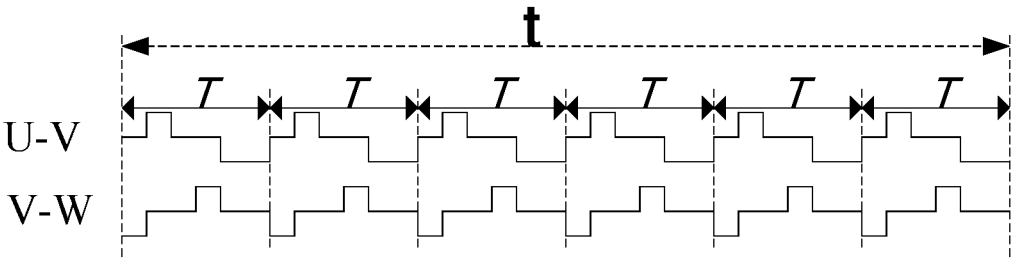
FIG. 6 is a voltage waveform diagram of voltages U-V being superimposed and voltages V-W being superimposed according to some embodiments of the present disclosure.

The timing control signals generated by the main control board according to the six-pulse algorithm are shown in FIG. 3. The duty ratio of the first IGBT is different from the duty ratio of the fourth IGBT, the on-time of the first IGBT is less than the on-time of the fourth IGBT. The duty ratio of the second IGBT and the duty ratio of the fifth IGBT are the same (duty ratio is 50%). The duty ratio of the third IGBT is the same as the duty ratio of the sixth IGBT (duty ratio is 50%). A voltage waveform diagram from the input side of the compressor to the node U (commonly referred to as U-phase voltage), a voltage waveform diagram from the input side of the compressor to the node V (commonly referred to as V-phase voltage) and a voltage waveform diagram from the input side of the compressor to the node W (commonly referred to as a W-phase voltage) can be obtained, as shown in FIG. 5, through the on/off control over the six IGBTs by the control waveform diagram of FIG. 3. The voltage waveform applied from the input side to the node U and the voltage waveform from the input side to the node V are superimposed, and the voltage waveform from the input side to the node V and the voltage waveform from the input side to the node W are superimposed, and the superimposed voltage waveform is shown in FIG. 6 (the voltage waveform obtained by superimposing the voltage waveform from the input side to the node U with the voltage waveform from the input side to the node W is the same as the voltage waveform obtained by superimposing the voltage waveform from the input side to the node U with the voltage waveform from the input side to the node V, which is not elaborated here).

In some embodiments, the main control board controls the turn-on and turn-off of the power device through high level and low level. As can be seen from FIG. 5, the duration of the high level applied to node U of the power device is different from the duration of the low level. Further, as can be seen from FIG. 8, the duration b at the low level is equal to the duration a at the high level plus ε, wherein the ε represents the time difference, and the unit of the ε may be seconds, milliseconds, microseconds, etc.; therefore a bias voltage is generated during the time of ε, so that the stator coil generates heat; wherein the ε has a value range of [0, T/2].

In some embodiments, the time difference between the time when the fourth IGBT starts to turn on and the time when the fifth IGBT starts to turn on in an adjacent level period is T/3, correspondingly, the time difference between the time when the first IGBT starts to turn off and the time when the third IGBT starts to turn off is also T/3; the time difference between the time when the third IGBT starts to turn on and the time when the fifth IGBT starts to turn on may be T/6, and the time difference between the time when the sixth IGBT start to turn on and the time when the second IGBT starts to turn on may be T/6.

The main control board 10 is further configured to control the operation of the air conditioner 1 in response to the actual temperature of the oil pool 13 being greater than or equal to the preset startup temperature.

Figure 8:
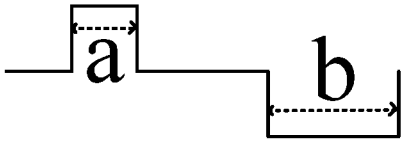
FIG. 8 is an unsymmetrical waveform diagram of a power device of an air conditioner according to some embodiments of the present disclosure.

In some embodiments of the present disclosure, a non 50%-symmetric duty ratio waveform control is performed on the first IGBT and the fourth IGBT, a 50%-symmetric duty ratio waveform control is performed on the second IGBT and the fifth IGBT, and a 50%-symmetric duty ratio waveform control is performed on the third IGBT and the sixth IGBT (FIG. 3 shows the non 50%-symmetrical duty ratio waveform control of the first IGBT and the fourth IGBT in the power device, the 50%-symmetrical duty ratio waveform control of the second IGBT and the fifth IGBT in the power device, and the 50%-symmetrical duty ratio waveform control of the third IGBT and the sixth IGBT in the power device within a time t; in order to prevent a certain stator coil from being kept in a heating state and other stator coils in a non-heating state, a non 50%-symmetrical duty ratio waveform control on the first IGBT and the fourth IGBT in the time t is performed, a 50%-symmetric duty ratio waveform control on the second IGBT and the fifth IGBT in the time t is performed, and a 50%-symmetric duty ratio waveform control on the third IGBT and the sixth IGBT in the time t is performed; in a next time t, a non 50%-symmetric duty ratio waveform control on the second IGBT and the fifth IGBT is performed, a 50%-symmetric duty ratio waveform control on the first IGBT and the fourth IGBT is performed, and a 50%-symmetric duty ratio waveform control on the third IGBT and the sixth IGBT is performed; and in another next time t, a non 50%-symmetric duty ratio waveform control on the third IGBT and the sixth IGBT is performed, a 50%-symmetric duty ratio waveform control on the first IGBT and the fourth IGBT is performed, and a 50%-symmetric duty ratio waveform control on the second IGBT and the fifth IGBT is performed; thereby ensuring that each stator coil generates heat; its waveform diagram is similar to that of FIG. 3, and is not elaborated here). One cycle of the voltage waveform obtained by superimposing the voltage waveform from the input side to the node U with the voltage waveform from the input side to the node V in FIG. 6 is shown in FIG. 8. At this time, an asymmetric AC pulse wave voltage is superimposed on the coils S2 and S3 of the compressor, and the rotor coil of the compressor generates heat due to induced current generated by electromagnetic induction. Meantime, due to the existing of the bias voltage ε, a bias DC voltage is superimposed on the coils S2 and S3 of the compressor. At this time, the stator coil of the compressor generates heat due to the DC bias current. As a result, the stator coil and the rotor coil are electromagnetically heated simultaneously, and the heating power is increased to satisfy the heating requirements of the compressor.

In some embodiments, the current acting on the stator coil and the rotor coil of the compressor has both an AC component and a DC component, and the heating power of the AC component is related to the value of the cycle period T. If a different cycle period T is selected, a different heating power will be produced for the AC component. The heating power of the DC component is related to the value of ε, if a different ε is selected, a different heating power will be produced for the DC component. In practical applications, ε acts on different stator coils respectively, therefore it is necessary to constantly switch the control signals shown in FIGS. 9, 10 and 11 to heat the oil pool, and the heating is stopped until the main control board determines that the actual temperature of the oil pool is higher than or equal to the preset startup temperature. The life span of the stator coil is prolonged while the stator coil is uniformly heated, and the switching period can be 100 seconds.

Figure 9:
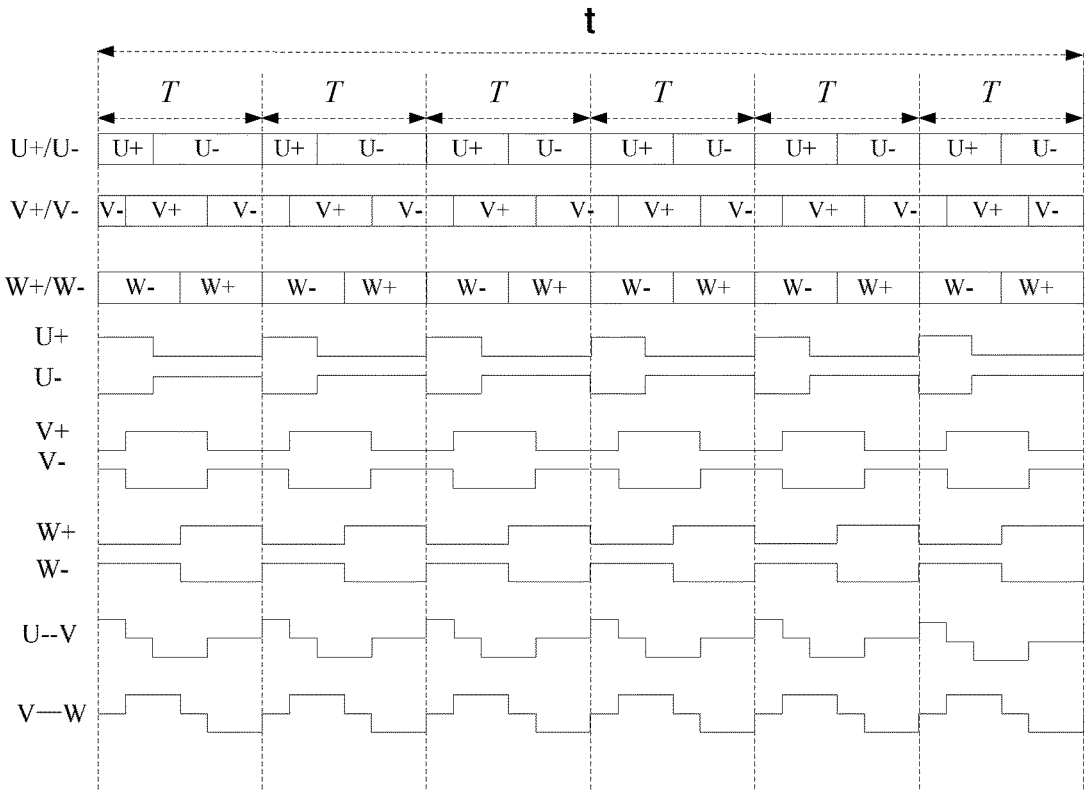
FIG. 9 is first timing signals generated by a main control board of an air conditioner according to some embodiments of the present disclosure.
Figure 10:
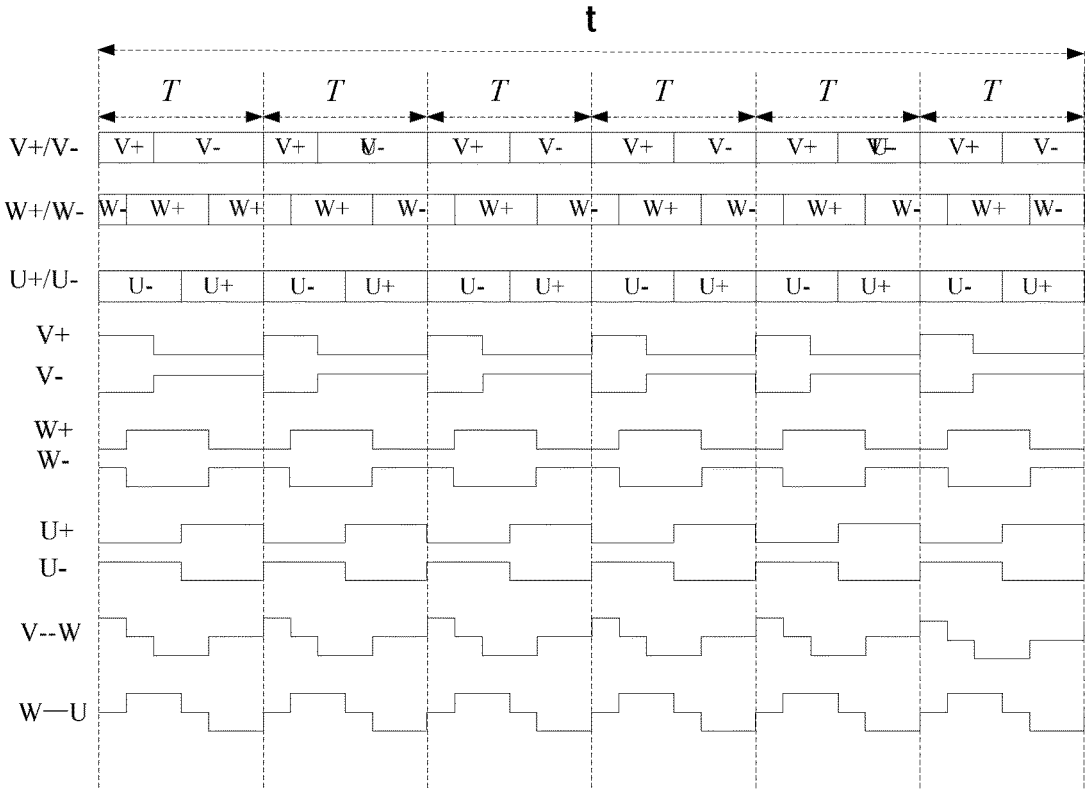
FIG. 10 is second timing signals generated by a main control board of an air conditioner according to some embodiments of the present disclosure.
Figure 11:
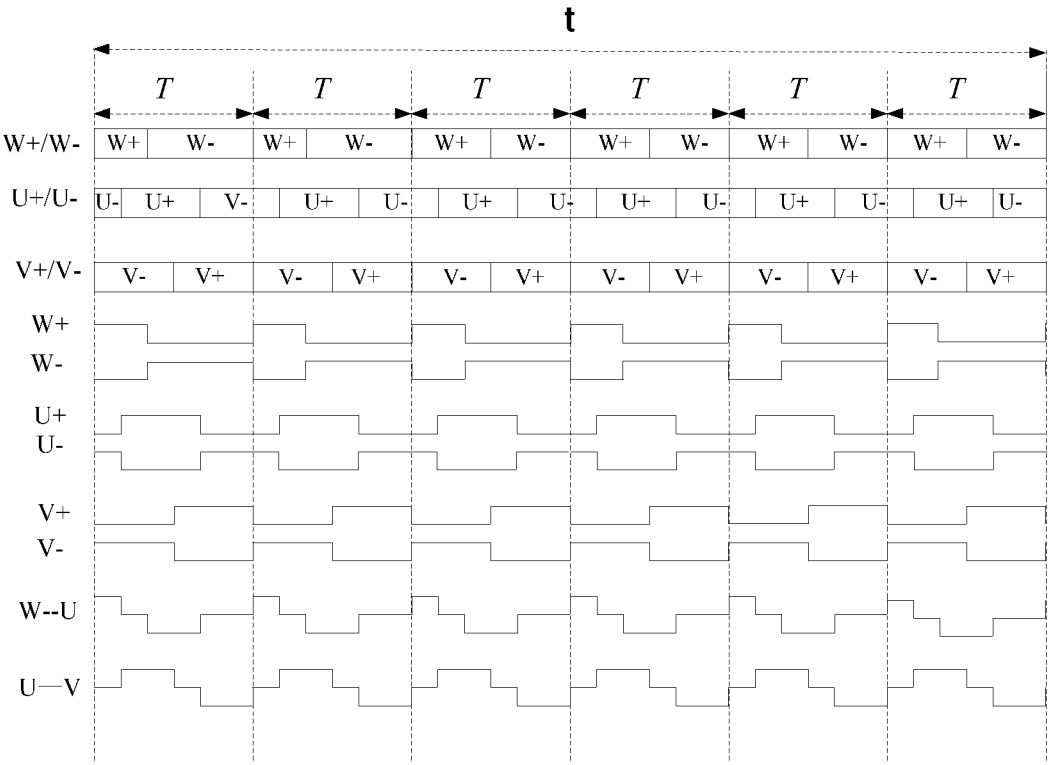
FIG. 11 is third timing signals generated by a main control board of an air conditioner according to some embodiments of the present disclosure.

In some embodiments, after heating is performed for a preset time according to the control signals shown in FIG. 9, reheating is performed for a preset time using the control signals shown in FIG. 10, and finally heating is performed for a preset time using the control signal shown in FIG. 11. After that, heating is stopped if the main control board determines that the actual temperature of the oil pool is higher than or equal to the preset startup temperature, or the oil pool is continued to be heated by constantly switching the control signals shown in FIGS. 9, 10 and 11 if the main control board determines that the actual temperature of the oil pool is lower than the preset startup temperature, and heating is stopped until the main control board determines that the actual temperature of the oil pool is greater than or equal to the preset startup temperature.

A different cycle period T or a different ε is corresponding to a different heating power value. Therefore, the staff can set the values of the cycle period T and ε according to the actual situation, which will not be elaborated here.

In some embodiments, the coil 120 includes three stator coils 1201; the power device 11 is configured to drive the coils to heat the oil pool 13 according to a timing control signals generated by the main control board 10, comprising: the power device 11 being configured to drive the three stator coils 1201 to heat the oil pool simultaneously according to the timing control signals generated by the main control board 10.

In some embodiments, the power device 11 is further configured to drive the three stator coils to generate direct current (DC), and drive the three stator coils 1201 to heat the oil pool 13 according to the DC.

In some embodiments, the coil 120 further includes a rotor coil 1202; the power device 11 is configured to output a pulse width modulated (PWM) pulse-converted voltage according to timing control signals generated by the main control board 10; the power device 11 is further configured to drive the stator coils 1201 to generate a periodically varying currents according to the PWM pulse-converted voltage. The rotor coil 1202 is configured to generate induced currents and produce heat by sensing the periodically varying currents.

Figure 7:
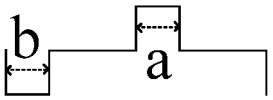
FIG. 7 is a symmetrical waveform diagram of a power device of an air conditioner according to some embodiments of the present disclosure.

In some embodiments of the present disclosure, a 50%-symmetric duty ratio control is performed on the second IGBT, the fourth IGBT, the third IGBT and the sixth IGBT. It can be seen from FIG. 5 that the duration of the high level applied to the node V of the power device is the same as the duration of the low level, and the duration of the high level applied to the node W of the power device is the same as the duration of the low level. It can be seen from FIG. 6 that the waveform within one cycle of V-W is shown in FIG. 7. At this time, the AC pulse wave voltage is superimposed on the coils S1 and S2 of the compressor. The duration "a" of the high level is the same as the duration "b" of the low level, that is, periodically varying voltages are formed, and thereby periodically varying currents are generated. As a result, varying AC electric fields are generated on the stator coils, and the rotor coil 1202 generates heat due to electromagnetic induction. Based on this, electromagnetic heating of the oil pool is achieved.

Some embodiments of the present disclosure provide an air conditioner that does not require an additional auxiliary electric heating belt for heating. Instead, the air conditioner provided in some embodiments of the present disclosure generates a required heating amount according to the actual temperature of the oil pool and the preset heating temperature after receiving a power-on signal of the air conditioner, then timing control signals are generated according to the required heating amount, and then the coils are driven to heat the oil pool according to the timing control signals, thereby reducing the manufacturing cost of the air conditioner. This solves the following problem: the manufacturing cost is very high when an auxiliary electric heating belt is added to the air conditioner in order to reduce the viscosity of the lubricating oil inside the compressor.

Figure 12:
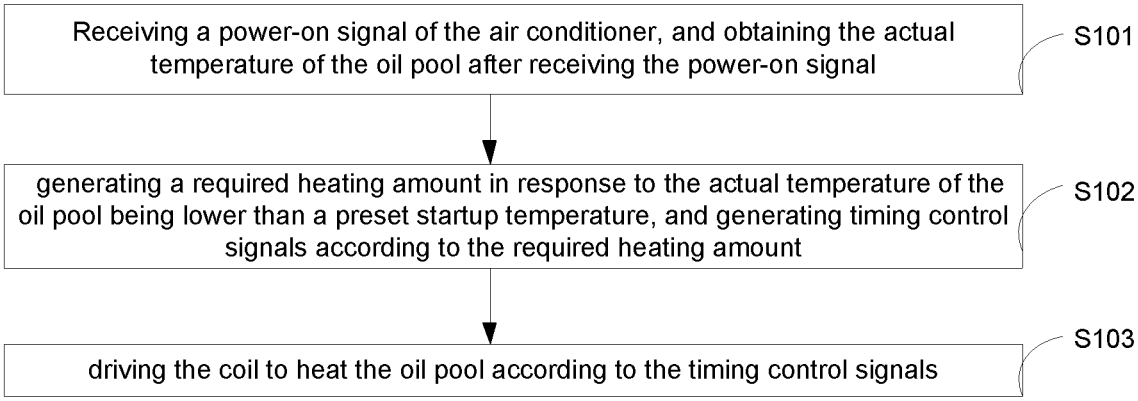
FIG. 12 is a schematic flow diagram of a control method of an air conditioner according to some embodiments of the present disclosure.

Some embodiments of the present disclosure also provide a method for controlling an air conditioner, applied to the air conditioner as described above. As shown in FIG. 12, the method includes:

S101: receiving a power-on signal of the air conditioner, and obtaining an actual temperature of the oil pool after receiving the power-on signal.

S102: generating a required heating amount in response to the actual temperature of the oil pool being lower than the preset startup temperature, and generating timing control signals according to the required heating amount.

S103: driving the coils to heat the oil pool according to the timing control signals.

In some embodiments, the preset startup temperature of the oil pool is higher than the actual temperature of the oil pool. And when the oil pool is heated to the preset startup temperature, can the refrigerant in the oil pool be transferred out of the oil pool. Therefore, when the required heating amount is generated, the required heating amount can be calculated according to the difference between the actual temperature and the preset startup temperature, thus avoiding the circumstance that parameters such as oil viscosity and oil pressure in the oil pool do not meet the booting conditions, caused by vaporization of a large amount of refrigerant in the oil pool during the booting, to cause damage to the air conditioner.

Figure 13:
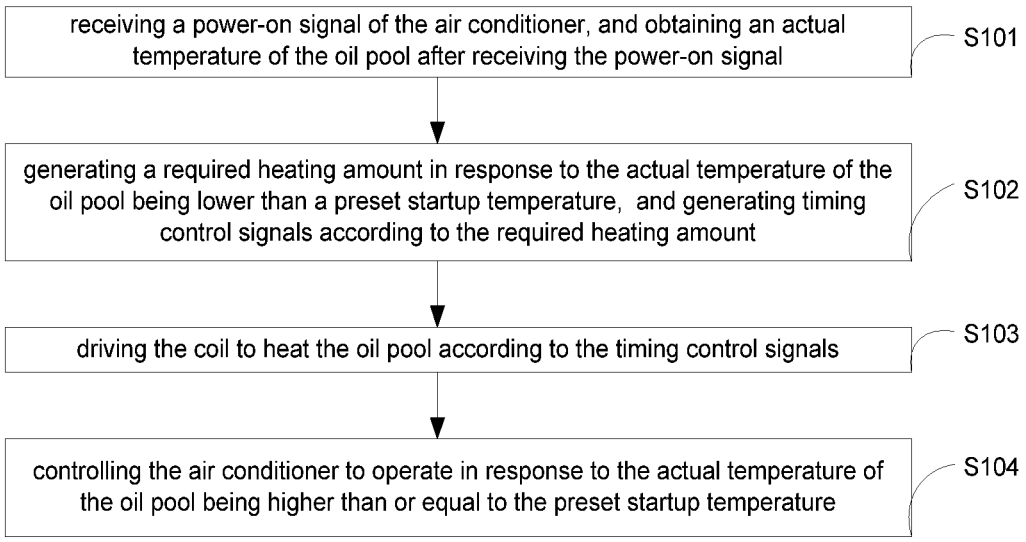
FIG. 13 is another schematic flow diagram of a control method of an air conditioner according to some embodiments of the present disclosure.

In some embodiments, as shown in FIG. 13, the method further includes:

S104: controlling the operation of the air conditioner in response to the actual temperature of the oil pool being higher than or equal to the preset startup temperature.

In some embodiments, the coil includes three stator coils. "Driving the coils to heat the oil pool according to the timing control signals" includes: driving the three stator coils simultaneously to heat the oil pool according to the timing control signals.

In some embodiments, "driving the three stator coils simultaneously to heat the oil pool according to the timing control signals" includes: driving the three stator coils to generate direct current (DC), and meantime driving the three stator coils to heat the oil pool according to the DC.

The coil further includes a rotor coil. "Driving the stator coils to heat the oil pool according to the timing control signals" includes: outputting a PWM pulse-converted voltage according to the timing control signals; driving the stator coils to generate periodically varying currents according to the PWM pulse-converted voltage; wherein the rotor coil generates induced currents and produces heat by sensing the periodically varying currents.

For all relevant contents in the steps relating to the embodiments of the above method, reference can be made to the description of functions of the corresponding devices, and the functions thereof are not elaborated here.

In case that an integrated device is adopted, the air conditioner includes a main control board; the main control board includes a storage unit, a processing unit, and an interface unit. The processing unit is configured to control and manage the actions of the air conditioner. For example, the processing unit is configured to support the air conditioner to perform the processes S101, S102, and S103 in FIG. 9; the interface unit is configured to perform information interactions with other devices. The storage unit is configured to store program codes and data of the air conditioner.

Figure 14:
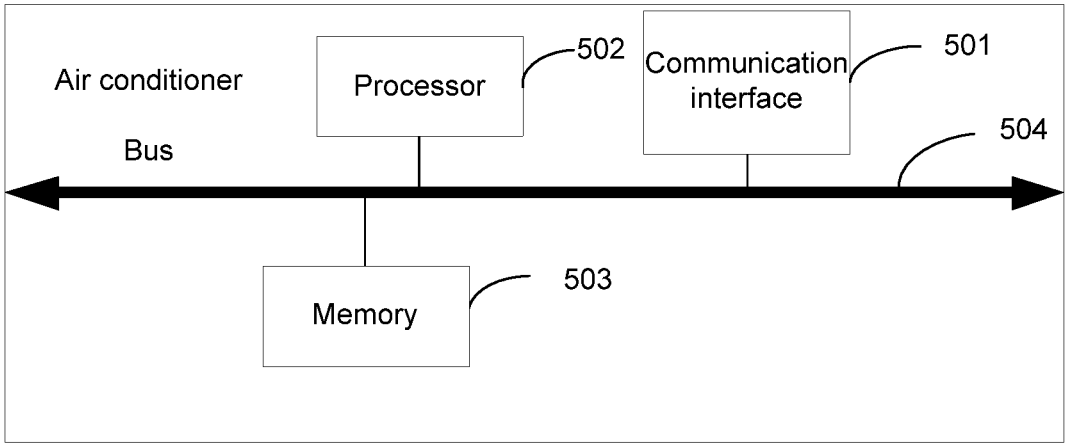
FIG. 14 is a schematic structural diagram of an air conditioner according to some embodiments of the present disclosure.

The following is taken as an example: the processing unit is used as a processor, the storage unit is used as a memory, and the interface unit is used as a communication interface. Referring to FIG. 14, the air conditioner includes a communication interface 501, a processor 502, a memory 503, and a bus 504. The communication interface 501 and the processor 502 are connected to the memory 503 via the bus 504.

The processor 502 can be a general purpose central processing unit (CPU), a microprocessor, an application-specific integrated circuit (ASIC), or one or more integrated circuits for controlling the execution of the program of the present application.

The memory 503 may be a read-only memory (ROM) or another type of static storage device that can store static information and instructions, a random access memory (RAM) or another type of dynamic storage device that can store information and instructions, an electrically erasable programmable read-only memory (EEPROM), a compact disc read-only memory (CD-ROM) or other optical disc storage (including a compact disc, a laser disc, an optical disc, a digital versatile disc, a Blu-ray disc, etc.), magnetic disk storage media or other magnetic storage devices, or any other medium that can carry or store the desired program codes in the form of instructions or data structures and can be accessed by a computer, but is not limited thereto. The memory can exist independently or be connected to a processor via a bus. The memory can also be integrated with the processor.

The memory 503 is used to store application codes for executing the solution of the present application, and is controlled by the processor 502 for execution. The communication interface 501 is used for information interaction with other devices, such as information exchange with a remote. The processor 502 is configured to execute the application codes stored in the memory 503 to implement the method described in the embodiments of the present application.

In addition, there is provided a computing storage medium including instructions for performing the operations in the method implemented by the air conditioner in the above embodiments when executed. Besides, a computer program product is provided, including the above-described computing storage medium.

It should be understood that in the embodiments of the present disclosure, the sequence numbers of the above processes do not imply the order of execution. The order of execution of a process should be determined by its function and internal logic, and should not limit the implementation processes in some embodiments of the present disclosure.

Those persons with ordinary skill in the art can realize that the units and algorithm steps of the examples described in the embodiments of the present disclosure can be implemented by means of electronic hardware or a combination of computer software and electronic hardware. Whether these functions are implemented in hardware or software depends on the specific application and design constraints of the technical solution. A person skilled in the art can use different methods to implement the described functions for each particular application, but such implementation should not be considered to be beyond the scope of the present disclosure.

Those skilled in the art can clearly understand that regarding the operating processes of the systems, devices and units described above, reference can be made to the corresponding processes in the embodiments of the above-mentioned method for the purpose of convenience and conciseness of the description, which will not be elaborated here.

In the several embodiments provided in the present application, it should be understood that the disclosed systems, devices, and methods can be implemented in other manners. For example, the embodiments of device described above are merely illustrative. For example, the division of the unit is merely a logical function division. In actual implementation, there may be another division manner, for example, multiple units or components may be combined or may be integrated into another system, or some features can be ignored or not executed. In addition, mutual coupling or direct coupling or communicative connection shown or discussed may be indirect coupling or communicative connection via some interfaces, devices or units, and may be in an electrical, mechanical or another form.

The units described as separate components may or may not be physically separated, and the components displayed as units may or may not be physical units, that is, may be located in one place, or may be distributed to multiple network elements. Some or all of the units may be selected according to actual needs to achieve the purpose of the solution of the embodiment.

In addition, the functional units in the embodiments of the present disclosure may be integrated into one processing unit, or each unit may exist physically separately, or two or more units may be integrated into one unit.

The functions described may be stored in a computer readable storage medium if they are implemented in the form of a software functional unit and sold or used as a standalone product. Based on such understanding, an essential portion of the technical solution of the present disclosure or a portion thereof that contributes to the prior art, or a portion of the technical solution can be embodied in the form of a software product stored in a storage medium, including a number of instructions that are used to cause a computer device (which may be a personal computer, a server, or a network device, etc.) to perform all or part of the steps of the method described in the embodiments of the present disclosure. The aforesaid storage medium includes: a U disk, a mobile hard disk, a read only memory (ROM), a random access memory (RAM), and various media that can store program codes, such as a magnetic disk or an optical disk.

The method for controlling the air conditioner provided in the embodiments of the present disclosure does not require an additional auxiliary electric heating belt for heating. Instead, the air conditioner provided in the embodiments of the present disclosure generates a required heating amount according to the actual temperature of the oil pool and the preset heating temperature after receiving a power-on signal of the air conditioner, then timing control signals are generated according to the required heating amount, and then the coils are driven to heat the oil pool according to the timing control signals, thereby reducing the manufacturing cost of the air conditioner. This solves the following problem: the manufacturing cost is very high when an auxiliary electric heating belt is added to the air conditioner in order to reduce the viscosity of the lubricating oil inside the compressor.

The above embodiments are merely specific embodiments of the present disclosure, but the scope of protection of the present disclosure is not limited thereto. For those skilled in the art, various changes and modifications can be made therein without departing from the spirit and essence of the disclosure, which are also considered to be within the protection scope of the disclosure. Therefore, the scope of protection of the present disclosure should be determined by the protection scope of the claims.

What is claimed is:

1. An air conditioner, including:

a compressor including a coil, wherein the coil includes three stator coils;

an oil pool connected to the compressor;

a main control board configured to receive a power-on signal of the air conditioner, obtain an actual temperature of the oil pool after receiving the power-on signal, generate a required heating amount in response to the actual temperature of the oil pool being lower than a preset startup temperature, and generate timing control signals according to the required heating amount;

a power device having a plurality of insulated gate bipolar transistors (IGBTs), wherein two sides of the power device are respectively connected to the main control board and the coil, and the power device is configured to drive the three stator coils to heat the oil pool simultaneously according to the timing control signals generated by the main control board.

2. The air conditioner according to claim 1, wherein the main control board is further configured to control the air conditioner to operate in response to the actual temperature of the oil pool being higher than or equal to the preset startup temperature.

3. The air conditioner according to claim 1, wherein the power device is further configured to drive the three stator coils to generate direct currents, and drive the three stator coils to heat the oil pool simultaneously according to the direct currents.

4. A method for controlling an air conditioner, which is applied to the air conditioner according to claim 1, including:

receiving a power-on signal of the air conditioner, and obtaining an actual temperature of the oil pool after receiving the power-on signal;

generating a required heating amount in response to the actual temperature of the oil pool being lower than a preset startup temperature, and generating timing control signals according to the required heating amount;

controlling the power device to drive the three stator coils to heat the oil pool simultaneously according to the timing control signals.

5. The method for controlling an air conditioner according to claim 4, wherein the method further includes:

controlling the air conditioner to operate in response to the actual temperature of the oil pool being greater than or equal to the preset startup temperature.

6. The method for controlling an air conditioner according to claim 4, wherein driving the three stator coils to heat the oil pool simultaneously includes:

driving the three stator coils to generate direct currents, and driving the three stator coils to heat the oil pool simultaneously according to the direct currents.

7. The air conditioner according to claim 1, wherein the power device includes an electrical signal input end A, an electrical signal output end B, and six IGBTs, and each IGBT includes a triode and a diode;

a collector of the first triode, a collector of the second triode, and a collector of the third triode each is connected to the electrical signal input end A; an emitter of the first triode is connected to a collector of the fourth triode and forms a node U at the junction, and an emitter of the second triode is connected to a collector of the fifth triode and forms a node V at the junction, an emitter of the third triode is connected to a collector of the sixth triode and forms a node W at the junction; a base of the first triode is connected to a first control signal input end, a base of the second triode is connected to a second control signal input end, and a base of the third triode is connected to a third control signal input end;

a cathode of the first diode is connected to the collector of the first triode, and an anode of the first diode is connected to the emitter of the first triode; a cathode of the second diode is connected to the collector of the second triode, an anode of the second diode is connected to the emitter of the second triode; a cathode of the third diode is connected to the collector of the third triode, and an anode of the third diode is connected to the emitter of the third triode;

an emitter of the fourth triode, an emitter of the fifth triode, and an emitter of the sixth triode each is connected to the electrical signal output end B; a base of the fourth triode is connected to a fourth control signal input end, a base of the fifth triode is connected to a fifth control signal input end, and a base of the sixth triode is connected to a sixth control signal input end;

a cathode of the fourth diode is connected to the collector of the fourth triode, and an anode of the fourth diode is connected to the emitter of the fourth triode; a cathode of the fifth diode is connected to the collector of the fifth triode, and an anode of the fifth diode is connected to the emitter of the fifth triode; a cathode of the sixth diode is connected to the collector of the sixth triode, and an anode of the sixth diode is connected to the emitter of the sixth triode.

8. The air conditioner according to claim 7, wherein, controlling the power device to drive the coil to heat the oil pool according to the timing control signals includes:

when in a first phase, controlling the first IGBT to be turned on, the second IGBT to be turned off, the third IGBT to be turned off, the fourth IGBT to be turned off, the fifth IGBT to be turned on, and the sixth IGBT to be turned on, within the power device;

when in a second phase, controlling the first IGBT to be turned on, the second IGBT to be turned on, the third IGBT to be turned off, the fourth IGBT to be turned off, the fifth IGBT to be turned off, and the sixth IGBT to be turned on, within the power device;

when in a third phase, controlling the first IGBT to be turned off, the second IGBT to be turned on, the third IGBT to be turned off, the fourth IGBT to be turned on, the fifth IGBT to be turned off, and the sixth IGBT to be turned on, within the power device;

when in a fourth phase, controlling the first IGBT to be turned off, the second IGBT to be turned off, the third IGBT to be turned on, the fourth IGBT to be turned on, the fifth IGBT to be turned on, and the sixth IGBT to be turned off, within the power device;

during the above four phases, the power device transmits an electrical signal input via the electrical signal input end A to the six IGBTs, and then to the electrical signal output end B through the coil connected to the six IGBTs to form a power supply loop, so as to heat the oil pool.

9. The air conditioner according to claim 7, wherein, controlling the power device to drive the coil to heat the oil pool according to the timing control signals includes:

when in a first phase, controlling the first IGBT to be turned on, the second IGBT to be turned off, the third IGBT to be turned off, the fourth IGBT to be turned off, the fifth IGBT to be turned on, and the sixth IGBT to be turned on, within the power device;

when in a second phase, controlling the first IGBT to be turned on, the second IGBT to be turned on, the third IGBT to be turned off, the fourth IGBT to be turned off, the fifth IGBT to be turned off, and the sixth IGBT to be turned on, within the power device;

when in a third phase, controlling the first IGBT to be turned off, the second IGBT to be turned on, the third IGBT to be turned off, the fourth IGBT to be turned on, the fifth IGBT to be turned off, and the sixth IGBT to be turned on, within the power device;

when in a fourth phase, controlling the first IGBT to be turned off, the second IGBT to be turned on, the third IGBT to be turned on, the fourth IGBT to be turned on, the fifth IGBT to be turned off, and the sixth IGBT to be turned off, within the power device;

when in a fifth phase, controlling the first IGBT to be turned off, the second IGBT to be turned off, the third IGBT to be turned on, the fourth IGBT to be turned on, the fifth IGBT to be turned on, and the sixth IGBT to be turned off, within the power device;

when in a sixth phase, controlling the first IGBT to be turned on, the second IGBT to be turned off, the third IGBT to be turned on, the fourth IGBT to be turned off, the fifth IGBT to be turned on, and the sixth IGBT to be turned off, within the power device;

during the above six phases, the power device transmits an electrical signal input via the electrical signal input end A to the six IGBTs, and then to the electrical signal output end B through the coil connected to the six IGBTs to form a power supply loop, so as to heat the oil pool.

10. An air conditioner, including:

a compressor including a first coil, a second coil, a third coil; the first end of the first coil, the first end of the second coil and the first end of the third coil are connect together;

an oil pool connected to the compressor;

a main control board configured to receive a power-on signal of the air conditioner, obtain an actual temperature of the oil pool after receiving the power-on signal, and generate timing control signals according to the actual temperature of the oil pool;

an electrical signal input end A, an electrical signal output end B and six IGBTs; an input pin of the first IGBT, an input pin of the second IGBT and an input pin of the third IGBT are connected to the electrical signal input end A, and an output pin of the fourth IGBT, an output pin of the fifth IGBT and an output pin of the sixth IGBT are connected to the electrical signal output end B; the output pin of the first IGBT is connected to both the input pin of the fourth IGBT and a second end of the third coil, and a node U is formed at the junction; the output pin of the second IGBT is connected to both the input pin of the fifth IGBT and a second end of the second coil, and a node V is formed at the junction; the output pin of the third IGBT is connected to both the input pin of the sixth IGBT and a second end of the first coil, and a node W is formed at the junction; a first control signal input pin of the first IGBT, a second control signal input pin of the second IGBT, a third control signal input pin of the third IGBT, a fourth control signal input pin of the fourth IGBT, a fifth control signal input pin of the fifth IGBT, a sixth control signal input pin of the sixth IGBT are connected with the main control board and configure to receive the timing control signals;

wherein, the timing control signals configure to:

in a first phase, control the first IGBT to be turned on, the second IGBT to be turned off, the third IGBT to be turned off, the fourth IGBT to be turned off, the fifth IGBT to be turned on, and the sixth IGBT to be turned on;

in a second phase, control the first IGBT to be turned on, the second IGBT to be turned on, the third IGBT to be turned off, the fourth IGBT to be turned off, the fifth IGBT to be turned off, and the sixth IGBT to be turned on.

11. The air conditioner according to claim 10, wherein, each IGBT includes a triode and a diode;

a collector of the first triode, a collector of the second triode, and a collector of the third triode each is connected to the electrical signal input end A; an emitter of the first triode is connected to a collector of the fourth triode at the node U, and an emitter of the second triode is connected to a collector of the fifth triode at the node V, an emitter of the third triode is connected to a collector of the sixth triode at the node W; a base of the first triode is connected to the first control signal input pin, a base of the second triode is connected to the second control signal input pin, and a base of the third triode is connected to the third control signal input pin;

a cathode of the first diode is connected to the collector of the first triode, and an anode of the first diode is connected to the emitter of the first triode; a cathode of the second diode is connected to the collector of the second triode, an anode of the second diode is connected to the emitter of the second triode; a cathode of the third diode is connected to the collector of the third triode, and an anode of the third diode is connected to the emitter of the third triode;

an emitter of the fourth triode, an emitter of the fifth triode, and an emitter of the sixth triode each is connected to the electrical signal output end B; a base of the fourth triode is connected to the fourth control signal input pin, a base of the fifth triode is connected to the fifth control signal input pin, and a base of the sixth triode is connected to the sixth control signal input pin;

a cathode of the fourth diode is connected to the collector of the fourth triode, and an anode of the fourth diode is connected to the emitter of the fourth triode; a cathode of the fifth diode is connected to the collector of the fifth triode, and an anode of the fifth diode is connected to the emitter of the fifth triode; a cathode of the sixth diode is connected to the collector of the sixth triode, and an anode of the sixth diode is connected to the emitter of the sixth triode.

12. The air conditioner according to claim 10, wherein, the timing control signals further configure to:

in a third phase, control the first IGBT to be turned off, the second IGBT to be turned on, the third IGBT to be turned off, the fourth IGBT to be turned on, the fifth IGBT to be turned off, and the sixth IGBT to be turned on;

in a fourth phase, control the first IGBT to be turned off, the second IGBT to be turned on, the third IGBT to be turned on, the fourth IGBT to be turned on, the fifth IGBT to be turned off, and the sixth IGBT to be turned off;

in a fifth phase, control the first IGBT to be turned off, the second IGBT to be turned off, the third IGBT to be turned on, the fourth IGBT to be turned on, the fifth IGBT to be turned on, and the sixth IGBT to be turned off;

in a sixth phase, control the first IGBT to be turned on, the second IGBT to be turned off, the third IGBT to be turned on, the fourth IGBT to be turned off, the fifth IGBT to be turned on, and the sixth IGBT to be turned off.

13. The air conditioner according to claim 1, wherein the power device includes an electrical signal input end A, an electrical signal output end B, and six IGBTs, and each IGBT includes a triode and a diode;

a collector of the first triode, a collector of the second triode, and a collector of the third triode each is connected to the electrical signal input end A; an emitter of the first triode is connected to a collector of the fourth triode and forms a node U at the junction, and an emitter of the second triode is connected to a collector of the fifth triode and forms a node V at the junction, an emitter of the third triode is connected to a collector of the sixth triode and forms a node W at the junction; a base of the first triode is connected to a first control signal input end, a base of the second triode is connected to a second control signal input end, and a base of the third triode is connected to a third control signal input end;

a cathode of the first diode is connected to the collector of the first triode, and an anode of the first diode is connected to the emitter of the first triode; a cathode of the second diode is connected to the collector of the second triode, an anode of the second diode is connected to the emitter of the second triode; a cathode of the third diode is connected to the collector of the third triode, and an anode of the third diode is connected to the emitter of the third triode;

an emitter of the fourth triode, an emitter of the fifth triode, and an emitter of the sixth triode each is connected to the electrical signal output end B; a base of the fourth triode is connected to a fourth control signal input end, a base of the fifth triode is connected to a fifth control signal input end, and a base of the sixth triode is connected to a sixth control signal input end;

a cathode of the fourth diode is connected to the collector of the fourth triode, and an anode of the fourth diode is connected to the emitter of the fourth triode; a cathode of the fifth diode is connected to the collector of the fifth triode, and an anode of the fifth diode is connected to the emitter of the fifth triode; a cathode of the sixth diode is connected to the collector of the sixth triode, and an anode of the sixth diode is connected to the emitter of the sixth triode.

14. The air conditioner according to claim 13, wherein, the power device being configured to drive the coil to heat the oil pool according to the timing control signals generated by the main control board includes:

in a first phase, the power device is configured to transmit an electrical signal input via the electrical signal input end A to the node U, and then to the electrical signal output end B through the coil to form a power supply loop, so as to heat the oil pool;

in a second phase, the power device is configured to transmit an electrical signal input via the electrical signal input end A to the node U and the node V, and then to the electrical signal output end B through the coil to form a power supply loop, so as to heat the oil pool;

in a third phase, the power device is configured to transmit an electrical signal input via the electrical signal input end A to the node V, and then to the electrical signal output end B through the coil to form a power supply loop, so as to heat the oil pool;

in a fourth phase, the power device is configured to transmit an electrical signal input via the electrical signal input end A to the node W, and then to the electrical signal output end B through the coil to form a power supply loop, so as to heat the oil pool.

15. The air conditioner according to claim 13, wherein, the power device being configured to drive the coil to heat the oil pool according to the timing control signals generated by the main control board includes:

in a first phase, the power device is configured to transmit an electrical signal input via the electrical signal input end A to the node U, and then to the electrical signal output end B through the coil to form a power supply loop, so as to heat the oil pool;

in a second phase, the power device is configured to transmit an electrical signal input via the electrical signal input end A to the node U and the node V, and then to the electrical signal output end B through the coil to form a power supply loop, so as to heat the oil pool;

in a third phase, the power device is configured to transmit an electrical signal input via the electrical signal input end A to the node V, and then to the electrical signal output end B through the coil to form a power supply loop, so as to heat the oil pool;

in a fourth phase, the power device is configured to transmit an electrical signal input via the electrical signal input end A to the node V and the node W, and then to the electrical signal output end B through the coil to form a power supply loop, so as to heat the oil pool;

in a fifth phase, the power device is configured to transmit an electrical signal input via the electrical signal input end A to the node W, and then to the electrical signal output end B through the coil to form a power supply loop, so as to heat the oil pool;

in a sixth phase, the power device is configured to transmit an electrical signal input via the electrical signal input end A to the node U and the node W, and then to the electrical signal output end B through the coil to form a power supply loop, so as to heat the oil pool.

16. An air conditioner, including:

a compressor including a coil, wherein the coil includes a stator coil and a rotor coil;

an oil pool connected to the compressor;

a main control board configured to receive a power-on signal of the air conditioner, obtain an actual temperature of the oil pool after receiving the power-on signal, generate a required heating amount in response to the actual temperature of the oil pool being lower than a preset startup temperature, and generate timing control signals according to the required heating amount;

a power device having a plurality of insulated gate bipolar transistors (IGBTs), wherein two sides of the power device are respectively connected to the main control board and the coil, and the power device is configured to output a pulse width modulated (PWM) pulse-converted voltage according to the timing control signals generated by the main control board, and the power device is further configured to drive the stator coil to generate periodically varying currents according to the PWM pulse-converted voltage, wherein the rotor coil is configured to sense the periodically varying currents, so as to generate induced currents and produce heat to heat the oil pool.

17. The air conditioner according to claim 16, wherein the main control board is further configured to control the air conditioner to operate in response to the actual temperature of the oil pool being higher than or equal to the preset startup temperature.

18. A method for controlling an air conditioner, which is applied to the air conditioner according to claim 16, including:

receiving a power-on signal of the air conditioner, and obtaining an actual temperature of the oil pool after receiving the power-on signal;

generating a required heating amount in response to the actual temperature of the oil pool being lower than a preset startup temperature, and generating timing control signals according to the required heating amount;

controlling the power device to output a PWM pulse-converted voltage according to the timing control signals; and controlling the power device to drive the stator coil to generate periodically varying currents according to the PWM pulse-converted voltage, wherein the rotor coil senses the periodically varying currents, generates induced currents, and produces heat to heat the oil pool.

19. The method for controlling an air conditioner according to claim 18, wherein the method further includes:

controlling the air conditioner to operate in response to the actual temperature of the oil pool being greater than or equal to the preset startup temperature.

* * * * *